US005193247A

United States Patent [19]

Placer et al.

[11] Patent Number: 5,193,247

[45] Date of Patent: Mar. 16, 1993

[54] FURNITURE HINGE

[75] Inventors: Anton Placer; Mihajlo Marjanovič; Klavdij Kocjan, all of Koper, Yugoslavia

[73] Assignee: Mednarodno podjetje LAMA, d.d. okovje - montazni sistemi - orodja - trgovina, Dekani, Yugoslavia

[21] Appl. No.: 782,306

[22] Filed: Oct. 24, 1991

[30] Foreign Application Priority Data

Jan. 23, 1991 [YU] Yugoslavia ..... P-108/91

[51] Int. Cl.[5] ..... E05D 7/04; E05D 7/12

[52] U.S. Cl. ..... 16/236; 16/239; 16/240; 16/249; 16/DIG. 43

[58] Field of Search ..... 16/235-240, 16/249, DIG. 43

[56] References Cited

U.S. PATENT DOCUMENTS 4,615,072 10/1986 Lautenschlager ..... 16/238
5,144,722 9/1992 Salice ..... 16/DIG. 43

FOREIGN PATENT DOCUMENTS 2528327 5/1976 Fed. Rep. of Germany ..... 16/236
3245227A1 7/1984 Fed. Rep. of Germany .
3444994A1 12/1986 Fed. Rep. of Germany ..... 16/249

OTHER PUBLICATIONS

UK Patent Application No. 2,178,791A, pub. Feb. 18, 1987, inventor: F. Ferrari.

*Primary Examiner*—R. L. Spruill
*Assistant Examiner*—Donald M. Gurley
*Attorney, Agent, or Firm*—Keck, Mahin & Cate

[57] ABSTRACT

The invention belongs to the area of fittings for furniture, and relates to a dismountable and adjustable hinge for the incorporation into units of furniture. The hinge comprises a hinge arm (1) tightened to a base plate (4) by means of a tightening screw (6), whose neck (6''') limiting a trapezoidal recess (6'') at each inclination of the hinge arm (1) cooperates with shoulder sections (10) of a longitudinal recess (10') of an intermediate step (17) of the base plate (4). Into a female thread (14) there is screwed a threaded bolt (5) for adjusting the inclination of the hinge arm (1) with respect to the base plate (4), resting by its bottom surface (5') on a first step (16) of the base plate (4), for the limitation of shifting of the bolt (5) in longitudinal direction there being provided an abutment (22). In order to realize stable and safe interconnection of the base plate (4) and the hinge arm (1) at each inclination, an arcuate depression (13) with downwardly oriented transversal ribs (12) is foreseen, the ribs (12) continuously cooperating with ribs (11) foreseen on the upper surfaces of sidewalls of a third step (18) of the base plate (4).

6 Claims, 3 Drawing Sheets

FURNITURE HINGE

Figure 1:
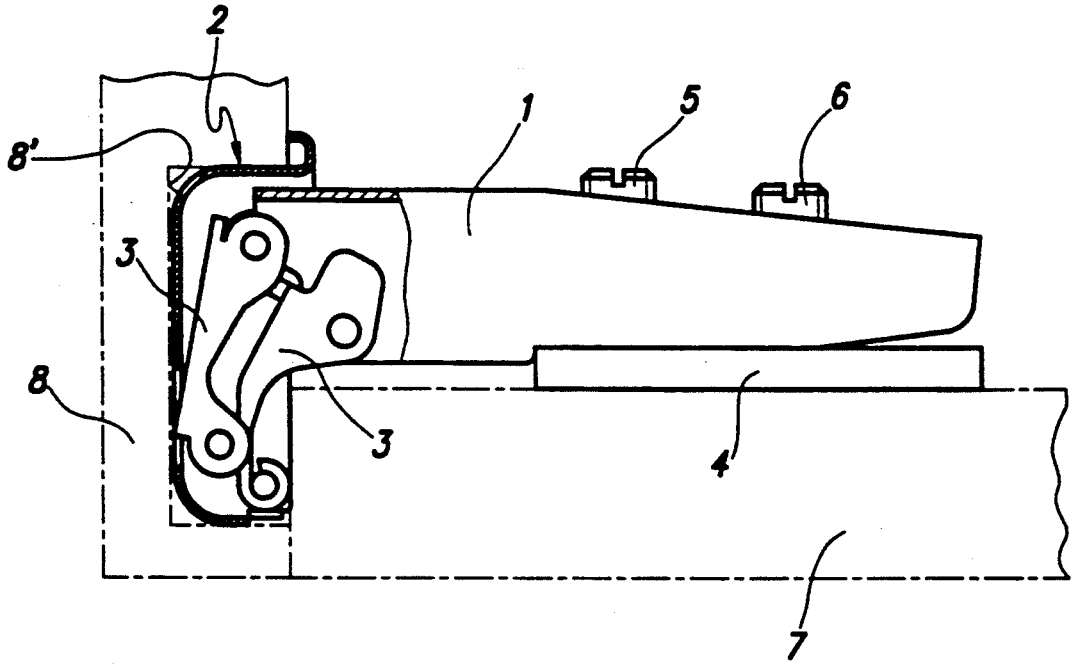

The present invention relates to a hinge for the incorporation into units of furniture, whereby at assembling or disassembling, respectively, said units of furniture, the hinge enables both quick assembling and disassembling as well as respective adjustment of the relative positions of components of these units, providing thereby stable and safe holding thereof in the assembly.

The object of the invention belongs to the field of construction engineering, particularly to fittings for hinging door leaves, window wings, and the like, in furniture industry.

According to the Int. Cl. (4th edition) the invention can be classified into Classes E 05 D 7/04 and E 05 D 7/12.

Several solutions of hinges of this type are known in prior art, the hinges essentially consisting of a hinge arm, which is by means of toggle joints swingably attached thereto connected to a dowel cup of the hinge, the latter being inserted into an appropriate blind hole provided, e.g., in the door leaf of the furniture unit, where the dowel cup is fastened by appropriate screws. On the other side the hinge arm is by means of a screw dismountably bound to a base plate, against which it is adjusted by means of a threaded bolt, the base plate in turn being fastened to, e.g., a side panel of the furniture unit.

A known solution of an adjusting hinge arm is shown in the German patent specification DE 34 44 994 A1. The solution provides a hinge arm tightened by a tightening screw to a base plate, said tightening screw arranged in a longitudinal slot of the hinge arm, having a standard buttonhead, beneath which there is positioned a washer as an additional element made of an elastic and/or plastic material. Besides, in the direction towards the end of the hinge arm, foreseen to receive the toggle joints, there is provided an adjusting threaded bolt screwed in a female thread located in the upper part of the hinge arm. By its even bottom surface this adjusting threaded bolt rests on a flat surface part of the base plate. At the opposite end section of the hinge arm the latter provides a vertically bent section of constituent sheet metal, which is also supported by a flat surface part of the base plate.

Due to the circumference that the position of the hinge arm inclined with respect to the base plate at adjustment of the hinge is in view of the tightening screw compensated by means of an elastic deformation of the washer, there is obvious a disadvantage of such an arrangement, namely, disregarding the extent of the tightening force exerted, only a little part of the cooperating surface of the screwhead is supported relatively faultlessly. Such a connection in no way provides a stable and safe assembly of the hinge arm and the base plate. Besides, at such an inclination the vertical rear wall section of the hinge arm rests on the flat surface portion of the base plate merely by its sharp edge, which does not provide a stable and safe holding of the hinge arm prevented from undesirable shifting thereof in the longitudinal direction, together with the component part of the unit of furnitire attached hereto. Also, at such an inclination the adjusting threaded bolt rests only by a little part of its even bottom surface, which gradually leads to a deformation of the supporting area. This occurrence can lead to loosening and disassembling of the connection of the hinge arm of the base plate, accompanied with all undesirable consequences, such as unhinging of the door leaf of furniture unit.

Another known solution of a hinge arm and a base plate is shown in German patent specification DE 32 45 227 A1 (U.S. Pat. No. 4,674,150). At this solution the hinge arm is connected to the base plate by a countersunk screw, this screw being arranged in a respectively formed longitudinal slot of the hinge arm. An adjusting threaded bolt arranged at a distance thereof is screwed in a female thread foreseen in the upper section of the hinge arm. This adjusting threaded bolt, in turn, by its chamfered bottom surface rests on a slanting, ramp-like portion of the base plate. Besides, this hinge arm by its sidewalls, which by being bent downwards in transversal section form a ∩, rests on bottom surfaces of respective grooves foreseen in the base plate.

The drawbacks of also this solution become apparent at an inclined position of the hinge arm with respect to the base plate at adjusting the position of the hinge and thereby, e.g., a door leaf of a furniture unit. In this position the tightening screw merely rests by a little part of its countersunk screw on shoulder sections, which limit the longitudinal slot, without creating a tightening force sufficient to achieve stable and safe interconnection of the hinge arm and the base plate. Such a force cannot even be created in the position analyzed by straight edges of vertical sidewalls of the hinge arm, which also rest by little parts of their lengths in the respective grooves of the base plate only. The slanting portion of the base plate which supports the bottom surface of the adjusting threaded bolt can, in fact, create such a force, but only under the condition that one intends to shift the hinge arm in the direction towards said increasing slanting portion. When the hinge arm is shifted in the opposite direction which, e.g., occurs by pressing the leaf of a door onto the box body of a furniture unit, there can appear undesirable loosening and disassembling of this interconnection accompanied with all undesirable consequences, such as e.g. unhinging of the door leaf.

On the basis of statement given above, the technical problem solved by the object of the present invention is how to realize a constructional solution of a furniture hinge, particularly a hinge arm and a base plate, whereby at assembling and disassembling the units of furniture the hinge arm and the base plate enabled quick, easy, and exact assembling and disassembling, having in mind the condition that even in cases of extreme deflections of the hinge arm both in the direction to the unit of furniture and in the direction from same, as well as in the direction to a side panel thereof and in the direction from same, fastening of the hinge arm onto the base plate was by means of simply constructed interconnected elements realized rigidly and safely without additional straining, which led to loosening and disassembling of the connection of the hinge arm with the base plate.

In accordance with the above definition of the technical problem the aim of the invention is realized in novel manner in that in the hinge arm which in transversal section has the shape of a ∩, at its rear end section an arcuated depression is foreseen, below which there are arranged transversal ribs. In each position of the hinge arm at adjusting thereof both as to orientation as well as to height, these ribs continuously cooperate with respective transversal ribs provided on sidewalls of the rear end section of the base plate. Thus, stable and safe interconnection of the hinge arm and the base plate of the hinge, accompanied with respective components of the furniture unit is attained, which is a first fundamental feature of the object of the invention.

Next to the arcuated depression, in the direction from the free end of the hinge arm, there is in the upper part of the hinge arm foreseen a female thread, into which a tightening screw is screwed, which under the interposition of a neck portion formed by means of a trapezoidal recess terminates by a lower end section. By means of said trapezoidal recess this neck mates a longitudinal recess of the base plate, the longitudinal recess being open at one end and terminated by a semicircular mantle section at the other end. This solution, which represents a further fundamental feature of the object of the invention, enables free inclination of the hinge arm with respect to the base plate at adjustment thereof both as to height as well as to orientation. Thereby, the tightening screw is easily adapted to each position, providing a sufficient contact area on shoulder sections of the longitudinal recess, not provoking additional and undesirable loading of said shoulder sections.

Next to the tightening screw there is in the upper part of the hinge arm provided another female thread into which an adjusting threaded bolt is screwed, whose bottom surface being even, chamfered, rounded, or the like, rests on a flat upper surface of a first step of the base plate of the hinge. Hereby, the base plate in longitudinal sectional elevation provides three gradually increased steps, which in transversal section by means of sidewalls form a box section of the base plate. More concretely, the first, i.e. the lowest, step is arranged at the front side of the base plate and is provided with an upright abutment for the limitation of the shifting stroke of the hinge arm as to orientation, said limitation being realized by striking the adjusting threaded bolt against said abutment. Thereby, the hinge arm is prevented from being disconnected from the base plate, when the tightening screw loosens as well as at adjustment of the hinge, which is a further feature of the object of the invention. The abovementioned longitudinal recess, open at one end, is arranged at an intermediate step of the base plate, and a third, i.e. a high-level step, is foreseen at the rear end section of the base plate. The last-mentioned, high-level step, provides transversal ribs at the upper surface of its sidewalls. Below said high-level step there is foreseen an idle space, which can be exploited to incorporate additional elements, e.g. for a specially quick incorporation of the hinge arm on the base plate.

Figure 2:
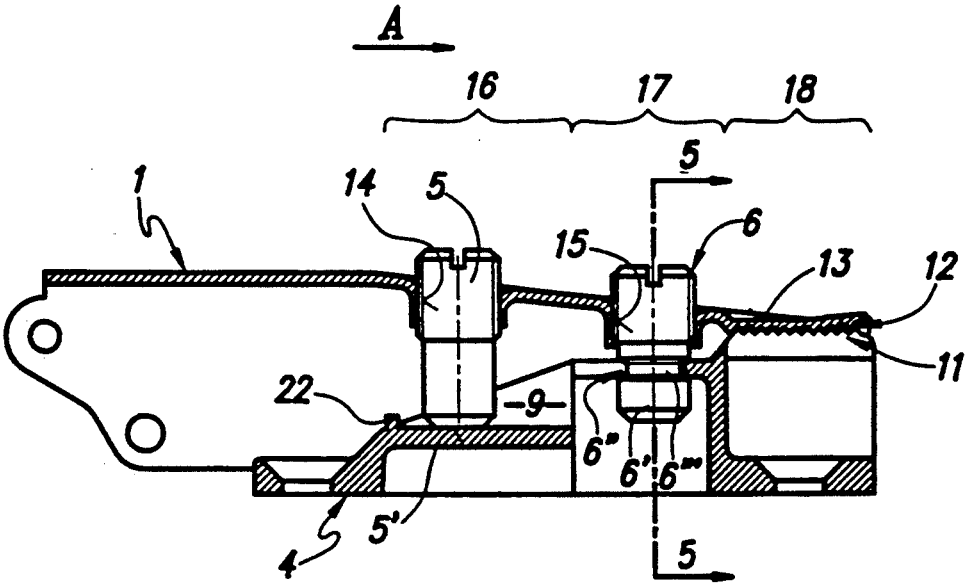
Figure 3:
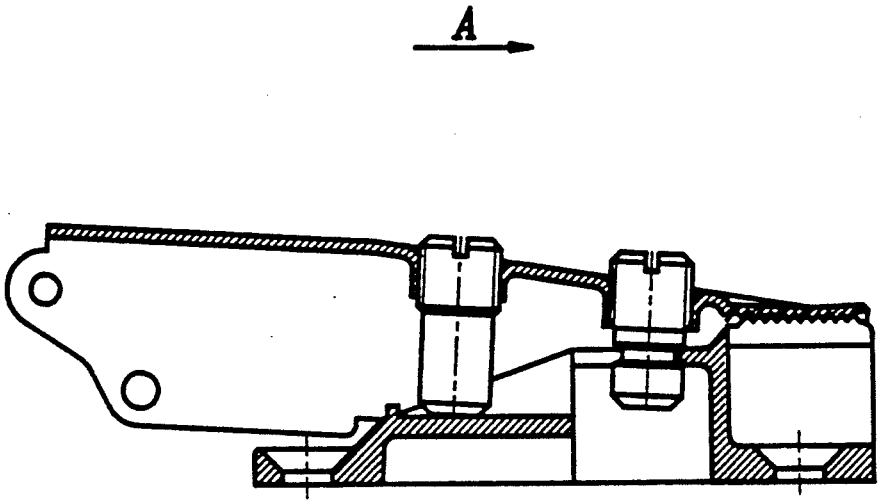
Figure 4:
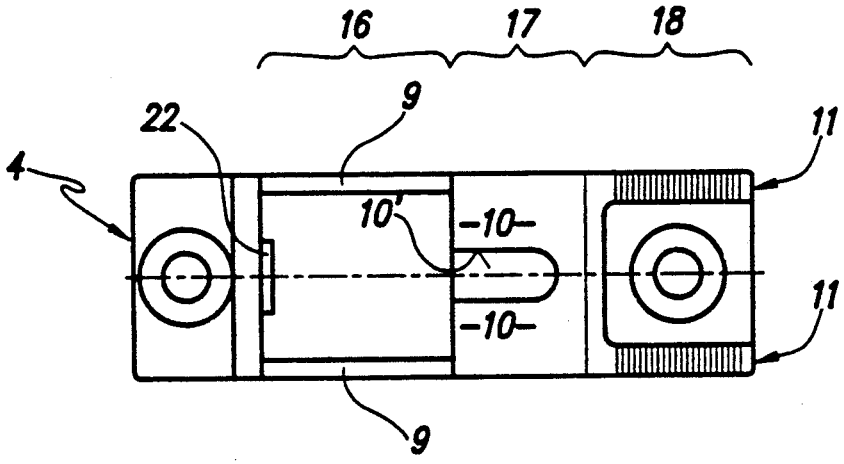
Figure 5:
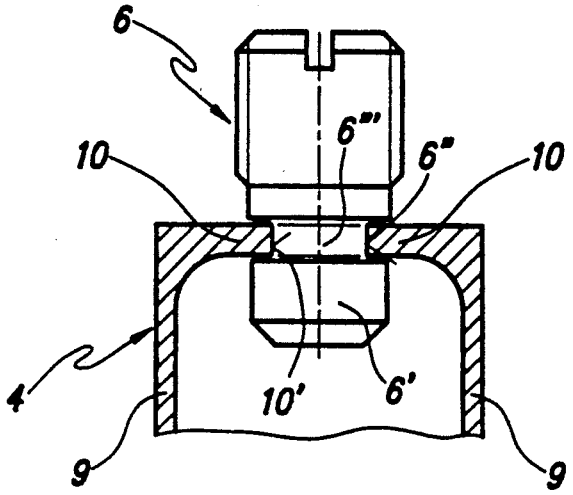
Figure 6:
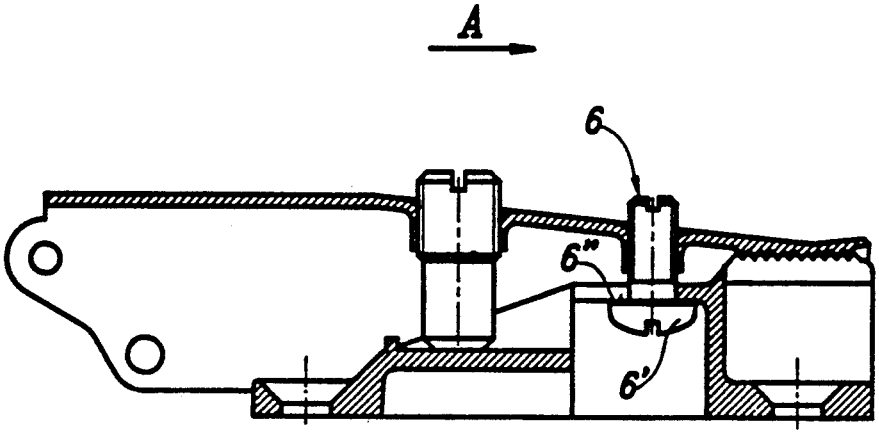

The furniture hinge according to the present invention will be shown and described in more detail by means of an embodiment, without limiting the invention thereby to the scope of embodiment of the hinge shown in the attached drawings, wherein show:

FIG. 1 a hinge according to the invention, incorporated in a unit of furniture,

FIG. 2 is a longitudinal sectional elevation of an assembly of a hinge arm and a base plate, representing the starting position of adjustment, FIG. 3 the same as FIG. 2, but in the position after the hinge arm has been maximally lifted at adjustment, FIG. 4 the top view of the base plate, FIG. 5 the transversal section through a tightening screw, the section being taken along line 5—5 of FIG. 2, and FIG. 6 a longitudinal sectional elevation of an assembly of the hinge arm and the base plate, whose tightening screw embodies a modified embodiment.

A furniture hinge, as shown in FIG. 1, is incorporated into a unit of furniture and comprises a hinge arm 1, which is under the interposition of two toggle joints 3 swingably connected to a dowel cup 2 of the hinge. This dowel cup 2, which is inserted into a blind hole 8'' of a leaf 8 of door of a unit of furniture, is by means of screws (not shown in the drawing) fastened to the leaf 8. On a side panel 7 of the unit of furniture there is by means of screws (not shown in the drawing) fastened a base plate 4 of the hinge, which dismountably and adjustably carries the hinge arm 1, the interconnection of said components being realized by means of a tightening screw 6. The hinge arm 1 as such is according to FIGS. 2, 3, and 6 bent to form the shape of a ∩ in transversal section, the free end part of the hinge arm 1 hereby providing an arcuated depression 13, below which there are arranged transversal ribs 12 for the cooperation with the respective ribs 11 provided on the upper surfaces of sidewalls of a high-level step 18 of the base plate 4 of the hinge. Next to the depression 13, there is over an intermediate step 17 of the base plate 4 foreseen a female thread 15 with, e.g., left-handed thread, into which the tightening screw 6 is screwed for tightening the hinge arm 1 on the base plate 4 of the hinge. Considering the fundametal feature of the hinge according to the invention, that namely the hinge arm 1 is adjustable with respect to the base plate 4 both as to length and to the height thereof, the tightening screw 6 is according to FIG. 5 formed to provide a neck 6''', under interposition of which the tightening screw 6 terminates by a lower end section 6', forming hereby a recess 6'. Hereby, the recess 6'' is trapezoidal, with the inclined surfaces of the recess 6'' cooperating with the upper and lower surfaces of shoulder sections 10 of an open recess 10' foreseen on the intermediate step 17 of the base plate 4, and with the parallel sides of the neck 6''' cooperating with the vertical surfaces of the shoulder sections 10 of the same recess 10'.

Next to the female thread 15 for the tightening screw 6 there is in the hinge arm 1 which in transversal section provides the form of a ∩, arranged a female thread 14, into which an adjusting threaded bolt 5 having a cylindrical threadless end part is screwed. At its cylindrical end part this adjusting threaded bolt 5 provides a bottom surface 5', which is even, rounded in form of a hemisphere, or the like, the adjusting threaded bolt 5 resting on a flat section of the first step 16 of the base plate 4 by means of said bottom surface 5'. At its front end part, the hinge arm 1 of FIGS. 1, 2, 3, and 6 provides openings in the sidewalls, for the incorporation of respective axles for connecting the toggle joints 3 and, by means of the latter, connecting the dowel cup 2, whereby said elements will not be explained in more detail due to the circumstance that they do not represent the substance of the invention.

The base plate 4 of the hinge provides three gradually increased steps, which are interconnected by sidewalls 9 forming a box section of the base plate 4 in the transversal section. Hereby, the first step 16 is the lowest one, and on its front border there is arranged an upright abutment 22 for striking the low end part of the adjusting threaded bolt 5 and thereby limiting the longitudinal shifting of the adjusting threaded bolt 5 together with the hinge arm 1 along the base plate 4 of the hinge. Following the first step 16 there is arranged an intermediate, higher step 17 which provides a recess 10' having an open port. This recess 10' is bordered by shoulder sections 10, whose surface sections are arranged normally to each other, the tightening screw 6 mating said surface sections by means of its inclined and straight surface sections of the trapezoidal recess 6'', which is one of the essential features of the invention.

Besides, the recess 10', when assembling a unit of furniture, guides the tightening screw 6 and thereby guides the hinge arm 1 in longitudinal direction of the latter, the lower end section 6' of the tightening screw 6 spanning below the recess 10', thereby providing an interconnection of the hinge arm 1 and the base plate 4 of the hinge at realization of said adjusting measure. At its rear end part the base plate 4 as such terminates by said third, high-level step 18 which is the highest part of the base plate 4 and which on the upper surfaces of its sidewalls provides transversal ribs 11. Additionally, said high-level step 18 is open in the direction to the end of the base plate 4, whereas its bottom section provides an opening for a countersunk screwhead of a standard screw, analogous to an opening provided at the opposite end of the base plate 4 in front of the first step 16. The base plate 4 is by last-mentioned countersunk screws fastened to, e.g., a side panel 7 of a unit of furniture.

FIG. 6 shows a variant to the furniture hinge of FIGS. 1 through 5 according to the invention. As evident from FIG. 6, the related to solution differs from the one disclosed in the above specification in the embodiment of the tightening screw 6, which in this solution has a standard-shape screwhead, whereas at the end section of the threaded part thereof a diametral slot for cooperation with a respective screwdriver is foreseen. The shaft of the tightening screw 6 is immediately next to the screwhead provided with a standard-shape recess 6'', by means of which the tightening screw 6 cooperates with the longitudinal, open recess 10' contacting the shoulder sections 10 of said recess 10', the screwhead, which forms the lower end section 6' of the tightening screw 6, spanning below said recess 10'.

The furniture hinge according to the invention is used in that a hinge arm 1 pre-fastened by means of the dowel cup 2, e.g. on a leaf 8 of door of a unit of furniture, is arranged on the base plate 4 of the hinge, already fastened on, e.g., a side panel 7 of same unit of furniture. At this arrangement, the free, open rear end section of the hinge arm 1 is slipped onto the front section of the base plate 4, the hinge arm 1 thus encompassing the sidewalls 9 of the base plate 4, whereafter the hinge arm 1 accompanied with a respective component part of a unit of furniture is pushed in the direction A of FIG. 2 (FIG. 3, FIG. 6). Hereby, the neck 6''' of the tightening screw 6 enters the open recess 10' of the intermediate step 17 of the base plate 4, whereafter the ribs 12 arranged below the arcuated depression 13, which is foreseen at the end part of the hinge arm 1, mate respective ribs 11 foreseen on surfaces of sidewalls of the third, high-level step 18. Stable interconnection of the hinge arm 1 and the base plate 4 is realized by screwing-in the tightening screw 6 provided with e.g. a left-handed thread, into the female thread 15 of the hinge arm 1. Hereby, in the course of this operation the lower end section 6' of the tightening screw 6 prevents lifting the hinge arm 1 from the base plate 4 of the hinge. The hinge arm 1 is now adjusted as to its height, whereby there is adjusted the extent of the gap between the leaf of the door and the side panel of the unit of furniture, the operation being performed by tightening or loosening the adjusting threaded bolt 5. Said adjusting threaded bolt 5, which by its bottom surface 5' rests on the upper surface of the first step 16 of the base plate 4, resting on said surface, lifts or lowers the hinge arm 1 to the position desired. In the course of this shifting, the ribs 12 belonging to the arcuated depression 13 of the hinge arm 1 roll on the ribs 11 belonging to the base plate 4, mating it, similarly to the rolling of a toothed wheel along a rack, whereby lifting or lowering of the hinge arm 1 as desired is enabled. Thanks to this essential feature of the subject of the invention there is at adjusting the height of the hinge arm attained continuous, stable, sufficiently rigid interconnection of the hinge arm 1 and the base plate 4 of the hinge, which prevents dismounting of a hinge arm 1 accompanied with, e.g., a leaf 8 of door of a unit of furniture, from the assembly, when attaching same to, e.g., a side panel 7 of a unit of furniture. At the starting assembling position of the hinge arm 1, as shown in FIG. 2, the lower edge of each sidewall of the hinge arm 1, said sidewalls in transversal section forming the legs of a ∩, rests on the basis part of the base plate 4 so that there are in this position provided two supports of the hinge arm 1, which receive the tightening force of the tightening screw 6, which results in a rigid interconnection of the hinge arm 1 and the base plate 4 of the hinge.

During the use of a unit of furniture it sometimes at opening a leaf 8 of a door by increased force occurs that the interconnection of the tightening screw 6 and the base plate 4 of the hinge slightly loosens. In order to avoid dismounting of the hinge arm 1 from the base plate 4 in this exceptional case, there is at the front border of the first step 16 of the base plate 4 foreseen an abutment 22, which in the situation mentioned stops the longitudinal movement of the hinge arm 1 and thereby prevents dismounting of the latter by abutting the cylindrical part of the adjusting threaded bolt 5 on said abutment 22.

At adjustment of the hinge arm 1 by height according to FIG. 3, as disclosed, the front part of the hinge arm 1 can be lifted with respect to the base plate 4. Thanks to the construction of the rear end part of the hinge arm 1, as disclosed, said lifting occurs by rolling the ribs 12 belonging to the arcuated rear end part of the hinge arm 1, on the ribs 11 belonging to straight upper edges of the rear end part of the base plate 4. At the procedure mentioned the hinge arm 1 is together with the adjusting threaded bolt 5 and the tightening screw 6 positioned under an inclination with respect to the base plate 4. Taking into account this circumstance and aiming at providing stable and durable interconnection of the hinge arm 1 and the base plate 4 of the hinge according to the invention, the tightening screw 6 according to FIG. 5 is provided with a neck 6''', through which the tightening screw 6 terminates by a lower end section 6' forming thereby a trapezoidal recess 6'' as explained above. This trapezoidal form of recess 6'' makes possible easy inclination of the tightening screw 6 together with the hinge arm 1, the slanting surfaces of this recess 6'' ideally cooperating with the respective surface sections of the shoulder sections 10 along the recess 10', not generating thereby undesirable additional stresses and deformations thereof, which contributes to the stability and safety of interconnection of elements of the hinge in the assembly and which, in fact, is the object of the invention. In addition, the ribs 11 continuously and steadily mate the ribs 12 in this inclined position of the hinge arm 1 so that the safety of tightening the hinge arm 1 on the base plate 4 according to the invention is essentially higher than that of known constructional solutions of hinges of this type.

According to one of the embodiments of the invention, for which protection is claimed, it is foreseen that the hinge arm 1 is made of a 1 mm sheet metal by punching, bending and stamping, providing a basis width of 15.0 mm. After realizing said operations, the hinge arm 1 provides a transversal section in form of a ∩ having openings shown in FIGS. 1, 2, 3, and 6 as well as impressed ribs 12. After machining the M7-thread in respective openings (female threads 14 and 15) there follows final treatment of the hinge arm 1, comprising removal of sharp edges and smoothing the mantle surface.

The base plate 4 of the hinge is made by die-casting process of a copper-zinc-nickel alloy. Thereby, all recesses evident in FIGS. 2, 3, 4, 5 and 6 as well as ribs 11 are obtained. After taking the cast from the die, the base plate 4 is surface treated, e.g., in a drum, to remove sharp edges and to smooth the mantle surface.

The adjusting threaded bolt 5 and the tightening screw 6 are machined by cutting technics, e.g. by means of turning lathe automatons, of a steel alloy, and are also surface treated.

The assembly of the hinge is completed after the hinge arm 1 has under interposition of appropriate axles and respective toggle joints 3 been interconnected with the dowel cup 2 of the hinge.

We claim:

1. Furniture hinge, comprising a dowel cup (2) of the hinge and a hinge arm (1), which are by means of suspended toggle joints (3) swingably connected to each other, the hinge arm (1) being dismountably and adjustably arranged on a base plate (4) of the hinge fastened to a side panel (7) of a unit of furniture, and at least on three points connected to the base plate (4), characterized in that the base plate (4) comprises, a lowest, first step (16), along a front edge of said first step an upright abutment (22) extends for stopping shifting of an adjusting threaded bolt (5), said first step (16) being followed by a higher, intermediate step (17), which has a longitudinal recess (10') open in the direction towards the first step (16) and terminated by a semicircular surface of shoulder sections (10) of said intermediate step, the recess (10') serving for cooperation with a neck (6''') of a tightening screw (6) and, finally, the intermediate step (17) of the base plate (4) being followed by a third, the highest step (18), which is hollow and open to the rear end of the base plate (4), the upper surfaces of sidewalls of said highest level step (18) having transversal ribs (11) to cooperate with respective ribs (12) of the hinge arm (1), the three steps (16, 17, 18) are interconnected by sidewalls (9), which in the transversal section form a box section of the base plate (4) of the hinge, the hinge arm (1) is ∩ shaped in transversal section and comprises a first female thread (14), into which an adjusting threaded bolt (5) is screwed having a bottom surface (5') resting on an upper surface section of the first step (16), and next to this female thread (14) in the hinge arm (1) is a further female thread (15), into which a tightening screw (6) is screwed extending into said recess of the base plate and, finally, a rear free end section of the hinge arm (1) is provided with an arcuate depression (13), below which on a lower side thereof are transversally oriented ribs (12) for mating with the ribs (11) of the base plate (4) of the hinge.

2. Furniture hinge, according to claim 1, characterized in that the arcuate depression (13) of the hinge arm (1), below which downwardly facing transversal ribs (12) are arranged, is formed following a circular arc, the shortest binding line between the center of this arc and the surface of the ribs (11) of the base plate (4) coinciding with the mating point of the ribs (12;11).

3. Furniture hinge, according to claim 1, characterized in that surface portions of the shoulder sections (10) along the recess (10'), belonging to the intermediate step (17) of the base plate (4), are flat.

4. Furniture hinge, according to claims 1, characterized in that the tightening screw (6) has a neck, said neck having a trapezoidal recess (6'') comprising slanting surface sections cooperating with upper and lower surface portions of the shoulder sections, straight lateral surface sections cooperating with vertical surface portions of the shoulder sections (10) along the recess (10').

5. Furniture hinge, according to claim 4, characterized in that the slanting surface sections of the recess (6'') of the tightening screw (6) are arranged at an inclination not smaller than the angle extent of the greatest realized inclination of the hinge arm (1) with respect to the base plate (4) at adjusting hinge.

6. Furniture hinge, according to claim 1, characterized in that the bottom surface (5') of the adjusting threaded bolt (5) is flat or, hemispherical.

* * * * *